United States Patent [19]

Vilain

[11] 4,222,682

[45] Sep. 16, 1980

[54] PLATFORMS FOR SEA-BOTTOM EXPLOITATION

[75] Inventor: Robert Vilain, Maisons-Alfort, France

[73] Assignee: Enterprise d'Equipments Mechaniques et Hydrauliques, E.M.H., France

[21] Appl. No.: 866,393

[22] Filed: Dec. 30, 1977

Related U.S. Application Data

[63] Continuation-in-part of Ser. No. 810,190, Jun. 27, 1977, Pat. No. 4,127,004.

[30] Foreign Application Priority Data

Jun. 30, 1976 [FR] France ..... 76 19967
Jun. 24, 1977 [FR] France ..... 77 19480

[51] Int. Cl.[2] ..... E02D 21/00
[52] U.S. Cl. ..... 405/203; 405/205
[58] Field of Search ..... 61/95, 101, 87, 89, 61/92, 94, 98, 97; 9/8 P; 175/7, 5; 114/254; 405/207, 208, 210, 205, 200, 202, 203, 224; 141/388

[56] References Cited

U.S. PATENT DOCUMENTS

| | | | |
|---|---|---|---|
| 2,589,153 | 3/1952 | Smith | 61/99 |
| 2,622,404 | 12/1952 | Rice | 405/207 |
| 3,611,734 | 10/1971 | Mott | 405/210 |
| 3,700,014 | 10/1972 | Scales et al. | 141/388 |
| 3,708,985 | 1/1973 | Pogonowski | 61/95 |
| 3,891,037 | 6/1975 | Well | 61/95 X |
| 3,922,868 | 2/1975 | McDonald et al. | 61/95 |

FOREIGN PATENT DOCUMENTS

| | | | |
|---|---|---|---|
| 551449 | 2/1943 | United Kingdom | 405/205 |
| 873089 | 7/1961 | United Kingdom | 61/101 |
| 133438 | 11/1960 | U.S.S.R. | 61/88 |

*Primary Examiner*—Dennis L. Taylor
*Attorney, Agent, or Firm*—Steinberg & Blake

[57] ABSTRACT

A sea-bottom, off-shore exploitation platform comprising a column having an emerged portion and a base for said column, intended to be laid down and anchored on the sea bottom, wherein the improvement consists in that the base is designed in the form of a tank floating and supporting said column during transport, said tank being sunk at the exploitation place.

13 Claims, 21 Drawing Figures

PLATFORMS FOR SEA-BOTTOM EXPLOITATION

Figure 1:
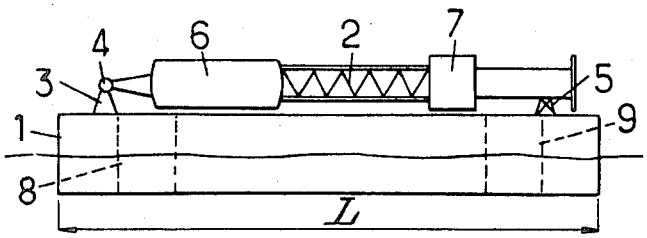

The present invention is a continuation-in-part of U.S. parent application Ser. No. 810,190, filed on June 27, 1977, now U.S. Pat. No. 4,127,004.

The present invention relates to off-shore-type platforms for oil-production units or installations and more particularly to platforms of the type comprising at least one column articulated on a base anchored to the sea bed which may be so designed as to allow for oil storage owing to its fluid-tightness.

Its purpose is mainly to permit the storage capacity of the base to be considerably increased and, at the same time, the sea carriage of the whole assembly to its place of submersion and anchoring to the sea bed to be facilitated.

It consists mainly in designing the base in the form of a tank of elongated shape capable of floating and of sufficient length to serve as a support for the column during the carriage to the anchoring location.

In the specific case where the column is articulated on its base by means of, in particular, a universal or Cardan joint, the articulation is advantageously provided in proximity to one of the small sides of the base in the form of a rectangle or the like, so that during the carriage by sea the column rests on the base lengthwise of the latter. During the submersion at the anchoring location use is made of ballasting means provided in the base to cause the latter to first assume an inclined position until it contacts the ground, and then the platform is freed to allow it to assume a substantially vertical position under the action of the thrust exerted by appropriate floats. Thereafter, there only remains to so ballast the base as to cause it to swing about its point of contact with the ground, until it entirely rests on the latter.

Of course several solutions may be contemplated in designing the base to be used as a tank.

According to a first alternative it may be designed in the form of a vessel with heave-resisting walls.

Another alternative consists in designing it in the form of a lighter container with means for allowing the access of sea water therein, during the carriage, the floatability being obtained by means of floats internal and/or external to the wall of the said tank base.

In any case, when the submersion and anchoring to the ground are completed (using any suitable ballasting means to ensure stability), there is obtained a large-capacity oil-storage tank, in combination, of course, with any valve system allowing the inflow of water or, on the contrary, its expulsion by the oil to be stored, both into and from the tank proper and the floats if any.

Apart from the above arrangements the invention comprises some other arrangements which are preferably used at the same time and will be referred to more explicitely later.

Also to be pointed out is the fact that the articulated column may not be used with advantage unless it is installed on development sites at relatively great depths of the order of one hundred meters or more. Indeed, such an articulated column must be provided with floats allowing it to be maintained in substantially vertical relationship to its base lying on the sea bed. In smaller depths the sizes of the floats must be increased to ensure a sufficient righting moment on the column. This increased size of the floats, however, renders the column much more heave-sensitive, so that in medium depths of the order of from 40 to 60 m, the articulated column becomes much less advantageous.

On the other hand, the known system using mooring buoys anchored by means of chains suffers from many drawbacks, including rapid wear of the chains and of the flexible oil-loading pipes. Another type of column for sea-bottom exploitation according to the present invention is remarkable in that it requires no mooring chains for its installation, in that the oil-supply pipes connected thereto are subjected to no strain or wear (they may be rigid) and in that it requires no righting floats, as an articulated column does, since it is rigidly secured to its base. Such a platform structure or exploitation column is therefore an ideal solution on medium-depth exploitation or development sites.

The invention also relates to a platform for sea-bottom exploitation, forming notably an emerging mooring and loading column connected to a gravity base intended to be sunk to the bottom, characterized in that the said column being permanently rigidly secured to the said base, which is preferably substantially symmetrical with respect to a vertical central axis, the said base is provided with a substantially frame-shaped structure at least a portion of which is provided with ballasting tanks, that the said column is mounted in perpendicular relationship to the medial plan of the said frame and substantially at its center, that it is connected to the said frame through connecting elements extending in substantially transverse relationship to the longitudinal axis of the column and that at least one transverse dimension of the said frame is greater than the depth of the sea bottom on the selected installation site.

The aforesaid connecting elements may also be designed as ballasting tanks (the ballasting mass may consist of concrete, iron scrap, lead shots, baryta or any other material whose density is sufficient to reliably fix the base on the sea bed by gravity).

On the other hand, the fact that the said transverse dimension of the frame is greater than the depth of the sea bottom allows the submersion of the base to be performed by a particularly accurate and reliable method. This method consists notably and successively:

in floating the said platform, the aforesaid ballasting tanks being substantially empty, in towing the said platform to the selected installation site, in simultaneously filling the tanks formed in the sections connecting the said column to the said frame, until the whole base is substantially submerged in proximity to the surface of the water, in causing the said frame to swing about one of its sides remaining substantially at the surface of the water, by progressively filling some of the tanks of the opposite side and/or the lateral sides, until the said side contacts and rests on the sea bed, and in causing the said frame to pivot in the other direction about the line at the bottom of the said opposite side, by progressively filling the tanks of the side previously maintained at the surface of the water and/or of the said lateral sides, until the whole frame rests on the sea bed.

The progressive filling of the ballasting tanks of the base thus allows a controlled sinking motion of the latter and its accurate positioning on the sea bed.

Figure 2:
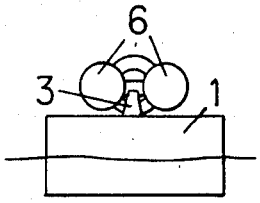
Figure 3:
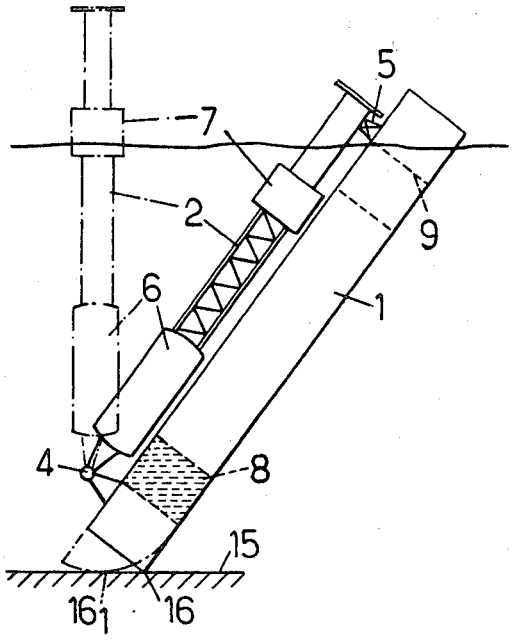
Figure 4:
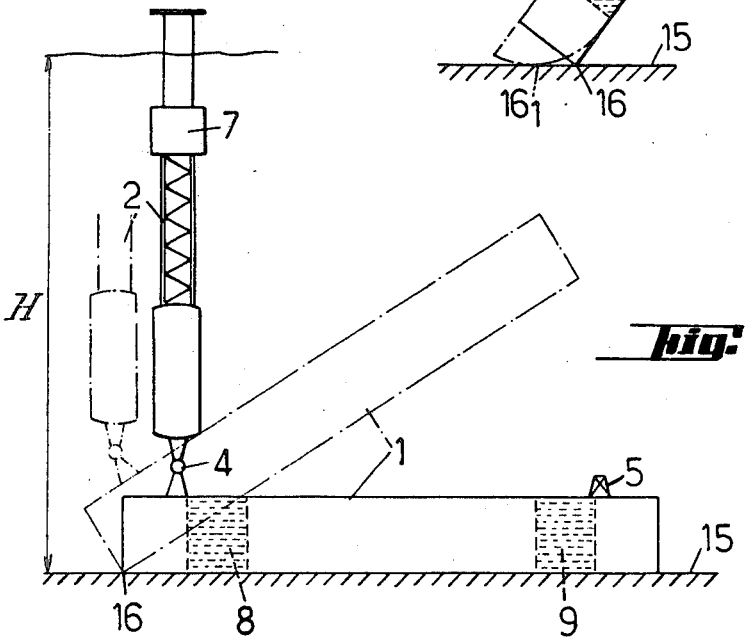
Figure 5:
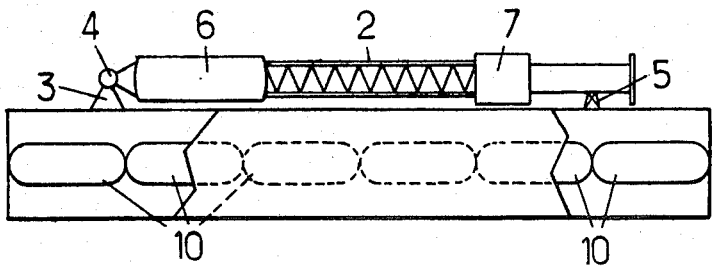
Figure 6:
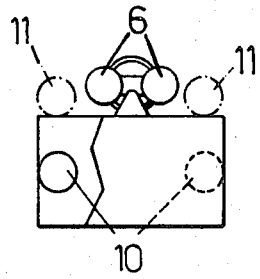
Figure 7:
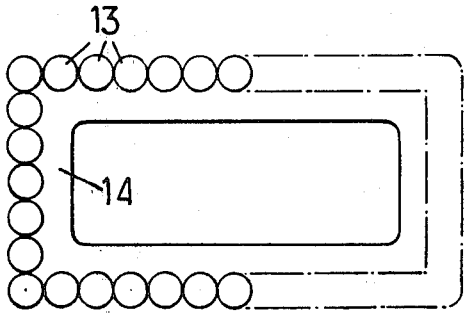
Figure 8:
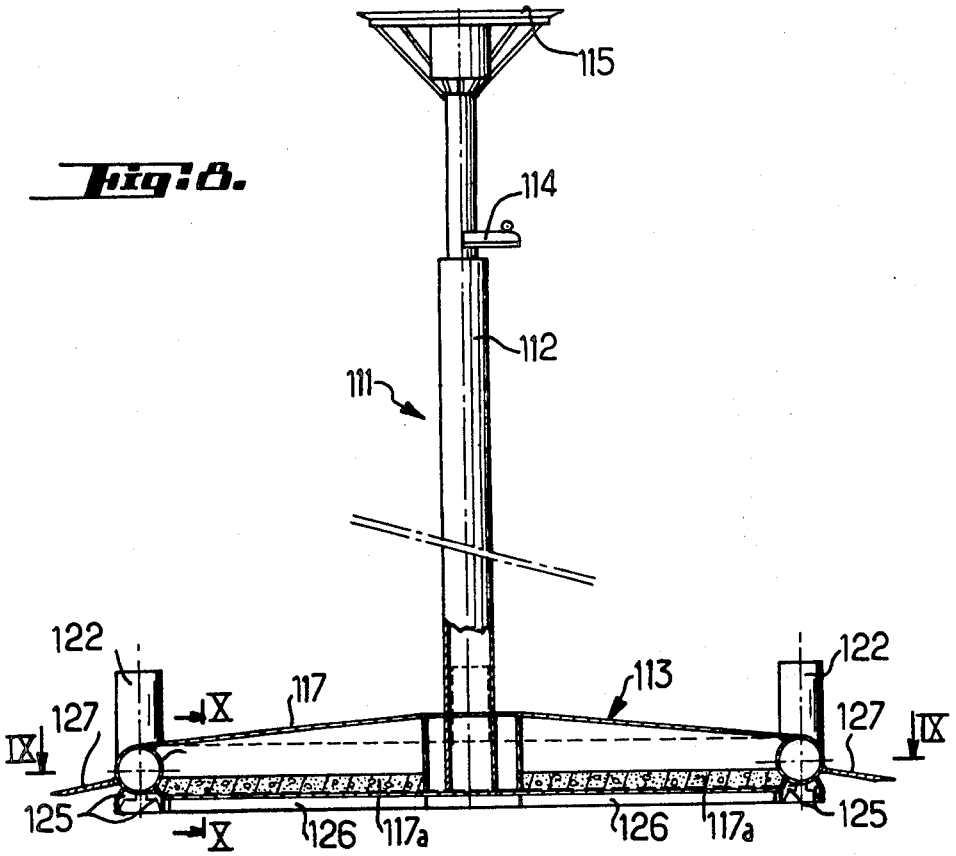
Figure 9:
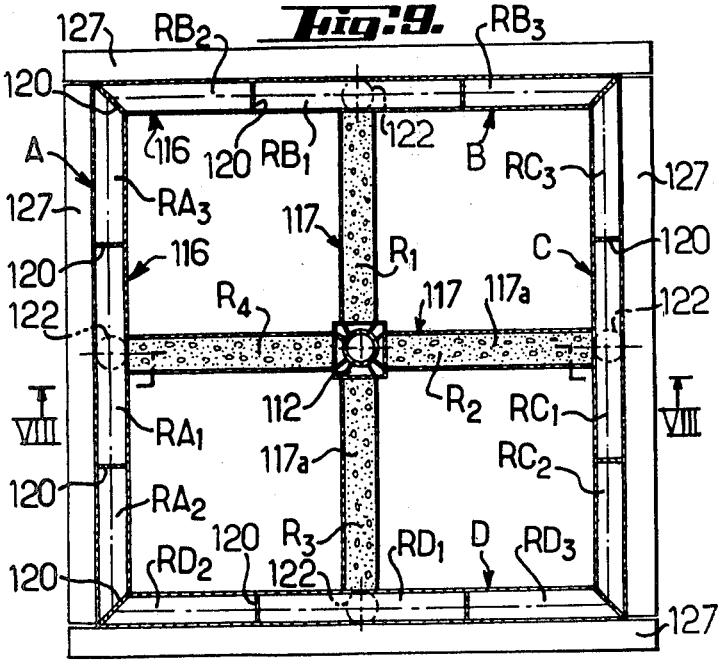
Figure 10:
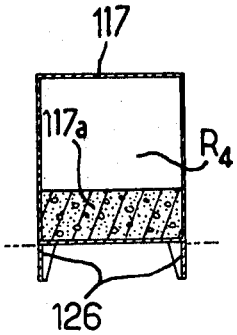
Figure 11:
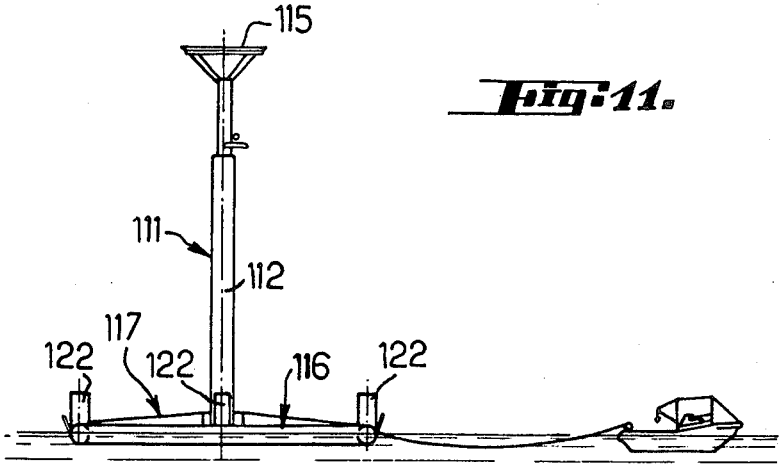

The invention will be better understood and other purposes, details and advantages of the latter will appear more clearly from the following explanatory description of several exploitation platforms forming mooring and loading columns according to the principles of the invention, given solely by way of example and made with reference to the appended non-limitative drawings wherein:

FIGS. 1 and 2 are diagrammatic elevational and side views, respectively, of the whole articulated column and its base, designed to be installed on sea beds at relatively great depths during sea transportation to the mooring location, FIGS. 3 and 4 are elevational views illustrating the various operations involved in the installation of the column assembly on the sea bed, FIGS. 5 and 6 illustrate such an assembly in the transport position, according to a modification of the invention, FIG. 7 illustrates another modification of a gravity tank according to the invention, FIG. 8 is an elevational view of an emerging mooring and loading column suitable for medium depths, shown partially broken away upon the sectional line VIII—VIII of FIG. 9, FIG. 9 is a top view, to a smaller scale, of the base, shown upon the sectional line IX—IX of FIG. 8, FIG. 10 is a sectional view, to a larger scale, upon the line X—X of FIG. 8, and FIGS. 11 to 17, as well as FIGS. 12*a*, 13*a*, 15*a* and 16*a*, are diagrammatic views of this same column and its base, illustrating a preferred method of installing the same on the selected development site.

According to a presently preferred form of embodiment of the invention, an off-shore platform of the type comprising columns articulated on a base by means of a universal or Cardan joint, notably for oil-fields about 100 to 150 m deep, is designed and installed as follows or in a similar manner.

The base of such a platform is constituted by a tank capable of being used for oil storage on the sea bed, the said tank being elongated in shape and its length being of the same order of magnitude as the length of the articulated column, thus allowing the said tank to be used, during sea-borne transportation, to support the column articulated thereto and resting on the said tank lengthwise thereof.

So, according to the form of embodiment diagrammatically illustrated in FIGS. 1 and 2, the said tank intended to serve as a base for the column is constituted by a parallelepipedic fluid-tight container 1 the selected length L of which is a little greater than the height H of submersion at the anchoring location on the underwater ground.

The length L is therefore sufficient to allow the column 2 to lie on the upper surface of the tank so as to be supported at its base end by a support 3 arranged in proximity to one of the smaller sides of the parallelepiped, with the universal or Cardan joint 4 possibly mounted from the outset, whereas it rests, at its other hand, on another temporary support such as 5. The platform is assumed to be equipped with tanks such as 6 and 7 serving as floats and possibly as ballasting means.

The said tank is provided at its ends with ballasting devices 8 and 9 intended to be used during the submersion as will be described later.

The tank, which must serve as a means of sea-borne transportation between the shore building-yard and the drilling site or the storage location may be designed in various manners.

According to a first alternative, as assumed in FIGS. 1 and 2, the tank (the length of which is therefore of the order of from 100 to 150 m or more) may be designed as a vessel whose upper portion is made fluid-tight. This solution may be perfectly contemplated, but it necessarily involves a heavy structure since the walls of the vessel must be capable of withstanding the heaving motion.

Another solution consists in ensuring the floatability of the tank not by itself but by means of appropriate float means provided either in the tank, as shown at 10 in FIGS. 5 and 6, or above, as shown at 11 in FIG. 6. These various methods may be used jointly.

The latter solution is more advantageous, since the walls of the tank are not notably subjected to heave, if care is taken up to allow sea level to obtain within the tank through inlets combined of course with valves, in which case the floats, constituted for example by cylinders 10 and/or 11, must be so designed as to support the apparent weight of the whole assembly. In this case, the structure of the tank may be much lighter.

The cylinders 10, 11, as well as the ballasting devices 8, 9 are combined with valve and pump systems to allow them to be emptied or filled with water at will.

A third solution is illustrated in FIG. 7 where it is assumed that the structure of the tank consists of an assembly, e.g. welded, of longitudinal pipes 13 in combination with transverse couples 14. Also in this case, the sea level can be allowed to obtain within the enclosed spaces thus formed (by means of suitable valves as in the previous case), so as to neutralize the heave effect, the floatability being obtained by means of pipes 13 either emptied or filled as desired.

Other forms of embodiment are of course possible.

In any case, whatever the form of embodiment adopted, the transportation and submersion are effected as follows.

FIGS. 1 and 2 show the assembly constituted by the tank and the column lying the length of the upper wall of the said tank. The assembly floating in that position with a shallow draught is moved from the building workshop to the submersion site either by means of an individual engine or by towage.

The ballasts 8 and 9 are empty or partially empty. So are the float cylinders where such floats are used. In this case (FIGS. 5 to 7) sea water is allowed to enter the tank through suitably controlled valves or inlets.

The submersion is performed as follows. In a first stage, a preliminary lowering of the assembly is effected by partially filling some of the ballast means 8, 9, while at the same time, of course, ensuring the transverse stability of the assembly owing to the said ballast means.

Thereafter, in a second stage, the filling is performed, more specially, of the ballast 8 which are nearest to the universal joint 4, thus causing the tank to sink together with the platform.

As a result of that operation, the tank lower end adjacent to the bottom of the column sinks until it contacts the sea bed 15 (FIG. 3), whereas its other end continues to float. During this movement, transverse stability is ensured by the unfilled upper ballasts 9 or the unfilled cylindrical floats (FIGS. 5 to 7) and also by the column main float 6 when submerged.

In a third stage, the temporary attachment or fastening between the upper portion of the column and the tank at 5 is released, thus allowing the column to assume a substantially upright position under the action of its floats 7, while remaining connected to the tank through only the universal joint at its bottom end and so being allowed to oscillate freely (FIG. 4).

In a four stage, the tank ballast chamber or chambers 9 opposite to the column bottom are filled. The tank then pivots about its lower edge 16 (FIGS. 3 and 4) which is in contact with the sea bed. The edge 16 thus bearing upon the sea bed along the full width of the tank ensures the transverse stability of the assembly during that time and prevents it from inclining laterally. The movement may thus continue until the tank lies entirely on the sea bed. The articulated production column thus assumes its normal position (FIG. 4).

It should be noted that, according to an advantageous form of embodiment represented by phantom lines at $16_1$ in FIG. 3, the lower end of the base tank may received a rounded shape which, as is known both from experience and through calculations, allows the stability during the pivoting movement to be increased.

The tank being thus laid on the sea bed, it is to be noted that at that moment the said tank and its floats are filled with water. It is furthermore desirable, in order to ensure efficient anchoring, to fill at least some of the compartments of the tank or of the ballast chambers with sand, concrete or baryta ballast, whereas all the other compartments, floats or internal spaces presently filled with water will be available later to receive storage oil.

To perform the storage use is made, as is known, of a system of pumps and valves allowing the oil to enter by driving the water before it.

In particular, these means will be connected to a production platform located at a distance and connected thereto by an oil pipeline. The platform 2 itself may be designed in the form of a loading platform allowing for ship mooring, according to the arrangements provided for, notably, in U.S. Pat. No. 3,980,037.

As sufficiently appears from the foregoing description of design and operation, the unit or installation according to the invention offers over the already existing similar units a great number of advantages:

the possibility of maximum simplification of the operations required to install the platform and its base, the possibility, owing to the considerable dimensions of the base, the length of which is of the same order of magnitude as the depth of the working site, of obtaining a large-size storage tank, and yet, the possibility of sea-borne transportation with absolute safety owing to the relatively light floating assembly obtained, especially in those cases where water is allowed to enter the floating tank during the transportation, the floatability being ensured by floats.

Referring now more particularly to FIGS. 8 to 10, there is shown a sea-bottom exploitation or development platform 111 which in this case consists more particularly of a mooring and oil loading column 112 rigidly secured to a base 113 intended to be sunk to the sea bed. The upper portion of the column 112 is equipped with a pivoting mooring system 114 (such as the one described for example in U.S. Pat. No. 3,980,037 or patent application No. 736,365 in the name of the Applicant Company and may be provided with a helicopter-landing upper-deck or helipad 115 and more generally with all equipment necessary for its operation, motors, pumps etc. According to an important feature of the invention, the base is made up substantially of a frame 116, which is square in the example described and is provided with ballast chambers or tanks, and of a column 112 mounted at the center of the said frame in perpendicular relationship to its medial plan, the said column being connected to the frame through connecting elements 117 extending in substantially transverse relationship to the longitudinal axis of column 112. The connecting elements 117 are themselves adapted to serve as ballast chambers or tanks. Moreover, it is important to note that the length of one of the sides of the square frame 116 (or at least one transverse dimension of the frame if it has a different shape) is greater than the depth of the sea bed on the installation site. This feature combined with the method of submersion of the platform which will be described later, allows the base to be accurately and reliably positioned on the selected erection site. The said transverse dimension is by at least 40 to 50% greater than the said sea-bed depth and may notably constitute the longitudinal dimension of the base in the particular case where the latter is substantially rectangular.

In the example described the connecting elements 117 form a cross-brace, the arms of which extend along the mid-perpendiculars of the frame 116. The said arms, however, may also extend along the diagonals of the frame. Each connecting element 117 is of rectangular-section tubular structure (FIG. 10) defining a ballast chamber or tank $R_1$, $R_2$, $R_3$, $R_4$ adapted to receive ballast 117*a*, e.g. of concrete. Furthermore, also each side A, B, C or D of the frame 116 is of tubular structure (of circular section in the example illustrated) and is transversely partitioned (walls 120) into several sections defining the above-mentioned ballast chambers. So, according to the form of embodiment represented in FIGS. 8 and 9, three such chambers are provided along each side. The side A has three chambers or tanks $RA_1$, $RA_2$ $RA_3$, the side B is made up of the chambers or tanks $RB_1$, $RB_2$ and $RB_3$, the side C consists of the chambers or tanks $RC_1$, $RC_2$ and $RC_3$ and the side D comprises the chambers or tanks $RD_1$, $RD_2$ and $RD_3$.

The base 113 is also provided with stabilizing float-tanks 122 connected to the frame 116. These tanks may be for example four in number and so arranged as to form a square as can be seen in FIG. 9 where the tanks 122 are illustrated in phantom lines, so that each tank is located at the middle of one of the sides of the frame 116. On the other hand, the sides A, B, C and D of the frame 116 are longitudinally provided with stiffening iron-sections 125 projecting under the frame so as to be embedded in the sea floor when the base is installed, thus resulting in improved stability. The same applies to the connecting elements 117, which also are provided with longitudinal stiffening means such as 126. Lastly, it should be noted that anti-scouring panels 127 are hingedly mounted along the sides A, B, C and D. They are held upward before and during the installation of the platform and then folded down against the sea bed (situation represented in FIGS. 8 and 9) so as to prevent the ground around the base from being scoured under the action of the moving water.

The method of installing the platform on the selected site will now be described with reference to FIGS. 11 to 17.

Figure 12:
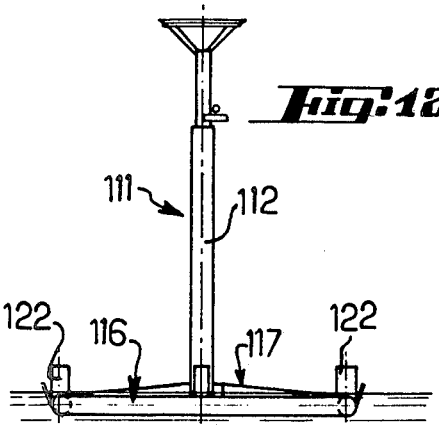
Figure 13:
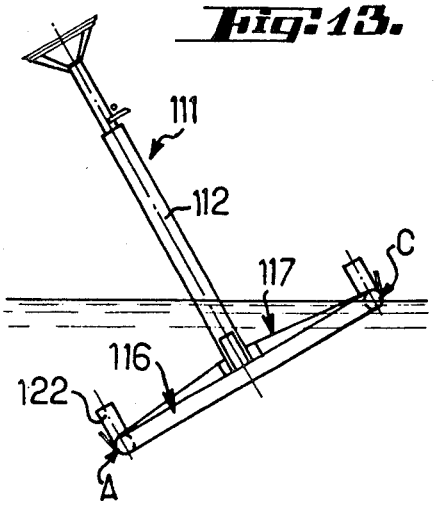
Figure 12A:
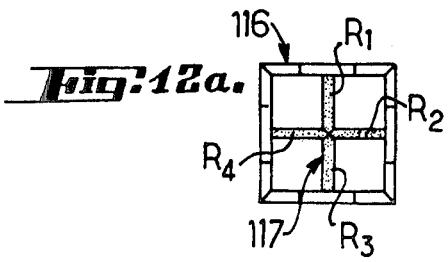
Figure 13A:
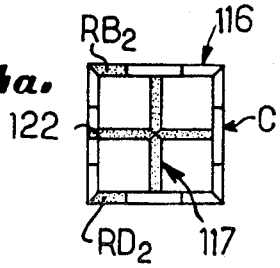
Figure 14:
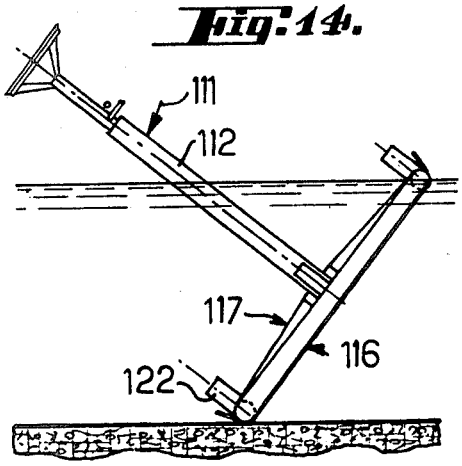
Figure 15:
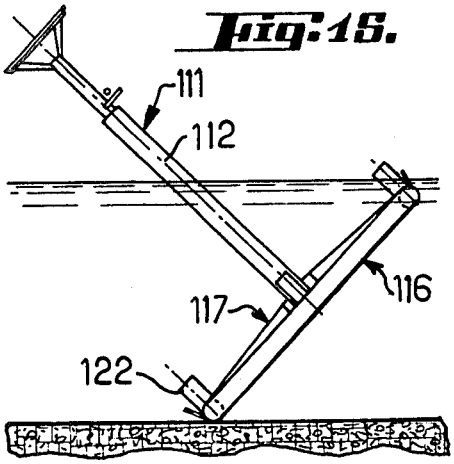
Figure 15A:
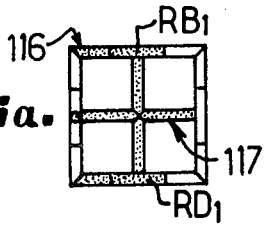
Figure 16:
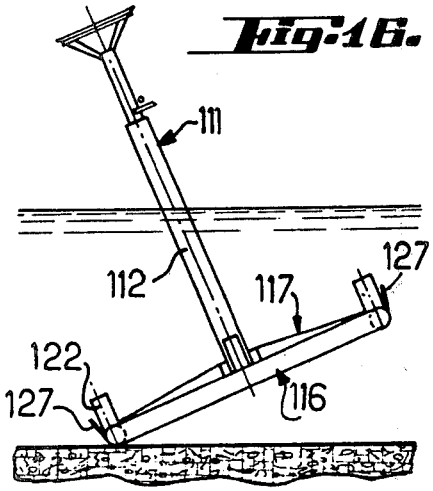
Figure 17:
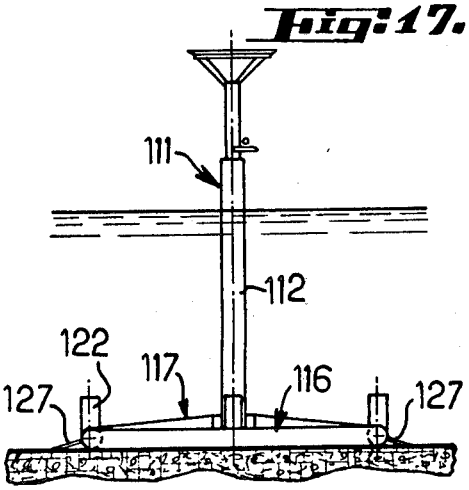
Figure 16A:
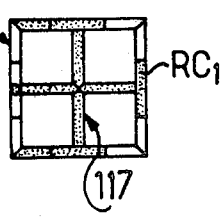

The platform 111 is first floated. For that, it is sufficient the above-described ballast tanks should be substantially empty. The platform (FIG. 11) is then towed to the selected installation site. Thereafter, the ballast tanks R1, R2, R3 and R4 provided in the elements 117 connecting the column 112 to the frame 116 are filled. This stage of the process illustrated in FIGS. 12 and 12*a* is continued until practically the whole base is submerged in proximity to the water surface. At this stage, the tanks 122, being empty, stabilize the platform. It is then sufficient to progressively fill some of the tanks of the frame 116 to cause it to tilt (FIG. 13) about one of its sides remaining substantially at the surface of the water. Thus, as shown in FIGS. 13 and 13*a*, if it is desired to cause the base to tilt about its side C, it is sufficient to progressively fill the ballast tanks $RB_2$ and $RD_2$ of the lateral sides B and D and also the stabilizing tank 122 of the opposite side A (or the tank $RA_1$) until the said opposite side A engages the sea bed. This situation is illustrated in FIG. 14. It should be noted that, at this stage, the base is at an angle of about 45° to the sea bed, leaving the upper portion of the column emerged, and at one of the sides of the said base has already engaged the sea bed whereas the other side is still emerged. This ensures considerable safety and high accuracy in installing the platform. For example, if it were found that, at this stage of the submersion of the base, the latter is not correctly positioned it would be sufficient to reintroduce air into the lateral tanks $RB_2$, $RD_2$ or into the stabilizing tank 122 to cause the side A of the base to rise slightly, to change the position of the latter and to again cause the base to tilt until the side A again engages the sea bed. Then the frame 116 is again caused to pivot in the other direction, but this time about the line along which the side A bears upon the sea bed, preferably by first filling the tanks $RB_1$ and $RD_1$ of the lateral sides B and D (FIGS. 15 and 15*a*), and then the tank $RC_1$ of the side C (FIGS. 16 and 16*a*), until the whole frame 116 finally lies on the sea bed at the desired location. Thereafter the filling of all the other tanks of the frame 116 is completed and the anti-scouring panels 127 (FIG. 17) are folded down to stabilize the platform once for all.

It should be noted that the equilibrium of the platform is ensured at any time during the double tilting of the base, the angular position of the latter being constantly controlled by progressively filling the tanks. Of course the described filling sequence of the ballast and/or stabilizing tanks in installing the platform on the exploitation site is given only by way of example and many modifications in the described process of installation of the platform may be contemplated without however departing from the scope of the present invention.

The invention therefore comprises all technical equivalents to the means applied, should the latter be used within the scope of the following claims.

What is claimed is:

1. A sea-bottom exploitation or development installation, forming an emerging mooring and loading column, connected with a gravity base intended to be laid on the sea bottom, wherein the said column is rigidly and permanently secured to the said base wherein said base is substantially symmetrical with respect to a vertical central axis thereof, and has a structure substantially in the form of a frame whose periphery is defined by a plurality of straight side members at least one portion of said frame comprising ballast tanks or chambers, wherein the said column is mounted in perpendicular relationship to the medial plan of the said frame and substantially at its center, and is connected to the said frame by connecting elements extending in substantially transverse relationship to the longitudinal axis of the column; at least one transverse dimension of the said frame being greater than the depth of the sea bottom at the selected installation site.

2. An installation according to claim 1, wherein at least part of the said connecting elements comprise ballast tanks or chambers.

3. An installation according to claim 1, wherein the said transverse dimension is at least by 40% to 50% greater than the said sea-bottom depth.

4. An installation according to claim 1, wherein the said frame is substantially square and that the said connecting elements form a cross-brace the arms of which extend for example along the mid-perpendiculars or along the diagonals of the said frame.

5. An installation according to claim 1, wherein stabilizing float tanks are connected to the said frame.

6. An installation according to claim 4, wherein stabilizing float tanks are connected to said frame and said stabilizing tanks are at least four in number and arranged symmetrically with respect to the central axis of the base.

7. An installation according to claim 1, wherein the side members of the said frame are of tubular structure and transversely partitioned into several sections defining the said ballast tanks.

8. An installation according to claim 1, wherein the sides of the said frame and/or the said connecting elements are provided longitudinally with stiffening iron-sections preferably projecting underneath the said frame.

9. An installation according to claim 1, wherein anti-scouring panels are hingedly mounted along the sides of the said frame so as to be raisable and lowerable against the sea bed.

10. An installation according to claim 6 wherein each stabilizing tank is connected to the substantial midportion of one of the frame sides.

11. A method of installing a sea-bottom exploitation or development installation, forming an emerging mooring and loading column, connected with a gravity base intended to be laid on the sea bottom, wherein the said column is rigidly and permanently secured to the said base wherein said base is substantially symmetrical with respect to a vertical central axis thereof, and has a structure substantially in the form of a frame whose periphery is defined by a plurality of straight side members at least one portion of said frame comprising ballast tanks or chambers, wherein the said column is mounted in perpendicular relationship to the medial plan of the said frame and substantially at its center, and is connected to the said frame by connecting elements extending in substantially transverse relationship to the longitudinal axis of the column; at least one transverse dimension of the said frame being greater than the depth of the sea bottom at the selected installation site, comprising the steps of:

floating the said installation, said ballast tanks being substantially empty, towing the said installation to the selected installation site, simultaneously filling the tanks provided in the elements connecting the said column to the said frame, until substantially the whole base is submerged in proximity to the surface of the water, causing the said frame to tilt about one of its sides remaining substantially at the surface of the water, by progressively filling some of the tanks on the opposite side and/or the lateral sides until the said opposite side engages and rests on the sea bed, and causing the said frame to pivot in the other direction about the line along which the said opposite side bears upon the sea bottom, by progressively filling the tanks of the side previously remained at the surface of the water and/or the said lateral sides, until the whole of the said frame is laid on the sea bed.

12. A method according to claim 11, wherein substantially all the tanks of the said frame are thereafter filled to ensure the final stability of the platform.

13. A method of installing an installation according to claim 11, said installation having anti-scouring panels hingedly mounted along the sides of the said frame so as to be raisable and lowerable against the sea bed, which comprises folding said anti-scouring panels down after the said frame is laid on the sea bed.

* * * * *

UNITED STATES PATENT AND TRADEMARK OFFICE

CERTIFICATE OF CORRECTION

PATENT NO. : 4,222,682

DATED : September 16, 1980

INVENTOR(S) : Robert Vilain

It is certified that error appears in the above-identified patent and that said Letters Patent are hereby corrected as shown below:

[73] Assignee: ENTREPRISE D'EQUIPEMENTS MECANIQUES ET HYDRAULIQUES E.M.H.

Signed and Sealed this

*Third* Day of *March 1981*

[SEAL]

*Attest:*

RENE D. TEGTMEYER

*Attesting Officer*

*Acting Commissioner of Patents and Trademarks*